United States Patent [19]

Carpenter et al.

[11] Patent Number: 5,048,649

[45] Date of Patent: Sep. 17, 1991

[54] LUGGAGE WITH PULL HANDLE

[75] Inventors: Lester E. Carpenter, Middletown; Wayne I. Schmitt, Coventry, both of R.I.; Laurence Snell, Attleboro, Mass.; David Bieber, East Greenwich, R.I.

[73] Assignee: American Tourister, Inc., Warren, R.I.

[21] Appl. No.: 487,459

[22] Filed: Mar. 2, 1990

[51] Int. Cl.[5] ..... A45C 5/14; A45C 13/22; A45C 13/28

[52] U.S. Cl. ..... 190/18 A; 190/115; 280/37

[58] Field of Search ..... 190/18 A, 18 R, 115, 190/37; 220/DIG. 3; 280/37, 47.371

[56] References Cited

U.S. PATENT DOCUMENTS

| | | | |
|---|---|---|---|
| 2,002,836 | 5/1935 | Rossi | 190/18 A X |
| 2,392,926 | 1/1946 | Kelly | 190/18 A X |
| 2,437,029 | 3/1948 | Howard | 280/DIG. 3 |
| 2,510,754 | 6/1950 | Norlin | 190/18 A |
| 2,581,417 | 1/1952 | Jones | 190/18 A X |
| 2,596,578 | 5/1952 | McIntyre et al. | 190/18 A X |
| 3,522,955 | 8/1970 | Warner, Jr. | 190/18 A X |
| 3,526,921 | 9/1970 | Aupke | 190/18 A X |
| 3,606,372 | 9/1971 | Browning | 190/18 A X |
| 3,655,215 | 4/1972 | Becklin | 190/18 A X |
| 3,799,568 | 3/1974 | Hager | 190/18 A X |
| 3,917,038 | 11/1975 | Foge et al. | 190/18 A |
| 3,989,128 | 11/1976 | Walker | 190/18 A |
| 3,997,038 | 12/1976 | Walker | 190/18 A |
| 4,062,429 | 12/1977 | Tabor et al. | 190/18 A |
| 4,244,452 | 1/1981 | Seynhaeve | 190/18 A |
| 4,299,313 | 11/1981 | Null | 190/115 X |
| 4,358,005 | 11/1982 | Fontana | 190/18 A |
| 4,358,006 | 11/1982 | Castelli | 190/18 A |
| 4,411,343 | 10/1983 | Cassimally | 190/115 X |
| 4,508,202 | 4/1985 | Siegert et al. | 190/18 A X |
| 4,538,709 | 9/1985 | Williams et al. | 190/18 A |
| 4,561,526 | 12/1985 | Winter et al. | 190/18 A X |
| 4,618,035 | 10/1986 | Mao | 190/18 A |
| 4,707,881 | 11/1987 | Van Hoye | 190/18 A |
| 4,759,431 | 7/1988 | King et al. | 190/18 A |
| 4,771,871 | 9/1988 | Lambracht | 190/18 A X |
| 4,838,396 | 6/1989 | Krenzel | 190/18 A |
| 4,852,705 | 8/1989 | Cowan, Jr. | 190/18 A |

FOREIGN PATENT DOCUMENTS

| | | | |
|---|---|---|---|
| 106906 | 5/1984 | European Pat. Off. | 190/18 A |
| 3302672 | 8/1984 | Fed. Rep. of Germany | 190/18 A |
| 3636064 | 4/1988 | Fed. Rep. of Germany | 190/115 |
| 59346 | 5/1954 | France | 190/18 A |
| 487220 | 11/1953 | Italy | 190/18 A |

*Primary Examiner*—Sue A. Weaver
*Attorney, Agent, or Firm*—Wood, Herron & Evans

[57] ABSTRACT

Luggage has a generally rectangular container. A vertical sheath is fixed to the inside of the container along an end wall. A rigid handle is slidably mounted in the sheath and when extended is pivotable to a forwardly-inclined attitude for pulling the luggage. A spring attached to the lower end of the handle returns the handle to a vertical position when it is released. Major wheels are mounted on the luggage by fixed transverse axles adjacent the bottom wall and centered between the forward and rearward end walls. A castered wheel is mounted on the bottom wall adjacent each end wall.

11 Claims, 7 Drawing Sheets

LUGGAGE WITH PULL HANDLE

BACKGROUND OF THE INVENTION

This invention relates to luggage.

It is known to mount castered wheels on the bottom wall of luggage and to provide a flexible strap for attachment to the end wall. The user pulls on the strap and the luggage rolls along the ground, thereby relieving the user of physically carrying heavily loaded luggage.

The arrangement of luggage and flexible strap works, but is not completely satisfactory. The flexible strap must be removed when the luggage is checked in at an airport or very likely the strap will be lost. A place must be found for the removed strap.

The flexible strap provides less than complete control of the luggage. If the castered wheels are stiff, they do not center properly and the luggage wanders, that is, it does not move in a straight line behind a user. The luggage will fall, particularly when walking fast or running. Luggage cannot turn corners very well, particularly if the casters are stiff.

The luggage must trail the user. The user cannot have the luggage alongside and inch it forward with the strap while standing in line at a ticket counter.

Other prior art consists of the following:

1) Luggage having a retracting flexible strap in an end wall.

2) Luggage having, on an end wall, a short, rigid, pivotally mounted pull handle cooperating with a pair of wheels on the opposite end of the luggage. This permits one end of the luggage to be lifted off the ground and pulled.

3) Luggage having a flat rigid handle that telescopes into the center of the side of hard sided luggage. Wheels mounted on the corner of the luggage directly below the handle permit the luggage to be tilted forward and pulled on the two wheels by the extended telescoping handle. The telescoping handle does not pivot.

4) A truck for moving articles from place to place, the truck having a platform mounted on two centrally located wheels, the platform having castered wheels at its forward and rearward ends and a rigid handle is provided to pull the truck.

BRIEF SUMMARY OF THE INVENTION

An objective of the present invention has been to provide an improved wheel and pull structure for luggage that puts the user more completely in control.

Another objective of the invention has been to provide a permanently-attached telescoping rigid pull for luggage that improves the stability of the luggage, its maneuverability and control.

Another objective of the invention has been to provide a wheel system for luggage imparting significantly improved maneuverability to the luggage.

These objectives of the invention have been attained by providing a rigid handle that is permanently attached to the luggage. When inoperative, the rigid handle is preferably telescoped in a sheath that is attached inside the luggage to an end wall. When in operative position, the handle is extended out of the tube.

A spring connects the lower end of the handle to the sheath so that the handle can be leaned forward for pulling the luggage. When the handle is released, the spring returns the handle to a vertical position, in alignment with its sheath, so that it is easily telescoped merely by pushing down on the top of the handle.

The handle can be pulled to and frictionally retained in an intermediate position between retracted and fully-extended. In this position, the handle can be used by the user standing alongside the luggage to inch the luggage forward.

The luggage is supported on two major wheels that are centrally located on the bottom of the luggage, preferably in wheel wells recessed into the luggage side walls, and a minor end wheel at each end of the luggage. Preferably but not necessarily, the end wheels are above the side wheels when the bottom wall of the luggage is horizontal. With this wheel arrangement, the luggage can be rolled with a three-wheel support or can, for maneuverability, be spun on a central axis simply by revolving about the two major wheels with the minor wheels not touching the ground.

Summarizing advantages of the rigid handle invention, the rigid handle connected directly to the luggage and pivotable forward when extended provides optimum control over the luggage. It does not have to be removed, for it telescopes within the luggage when not in use. When in intermediate position, the handle is used for inching along, as when standing in line at a ticket counter. It presents a narrow profile when wheeled through a crowd, as contrasted to the prior art telescoping handle luggage.

Summarizing the advantage of the improved wheel system, by providing major wheels centered on the luggage and castered wheels mounted on the ends, the maneuverability is vastly improved over prior wheel systems.

The combination of rigid handle and centered wheels provides vastly improved control over pulled luggage. No tilting and thus bearing the weight of the luggage is required.

BRIEF DESCRIPTION OF THE DRAWINGS

The objectives and features of the present invention will become more readily apparent from the following detailed description taken in conjunction with the accompanying drawings in which.

DETAILED DESCRIPTION OF THE INVENTION

Figure 1:
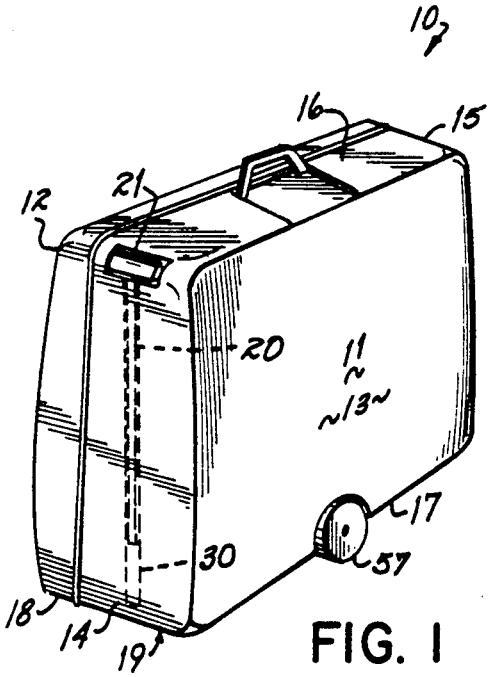
FIGS. 1–4 are perspective views illustrating the operation of the invention.

A hard-sided embodiment of the luggage is a container indicated at 10. It is generally known and is formed by a shell 11 enclosed by a lid 12. The shell has a side wall 13, a forward end wall 14, a rearward end wall 15, a top wall 16 and a bottom wall 17. The lid 12 forms a container side wall opposite side wall 13 and has a bottom wall 18 hinged to the shell bottom wall 17. Bottom walls 17 and 18 of the shell 11 and lid, respectively, form a container bottom wall 19.

Figure 4:
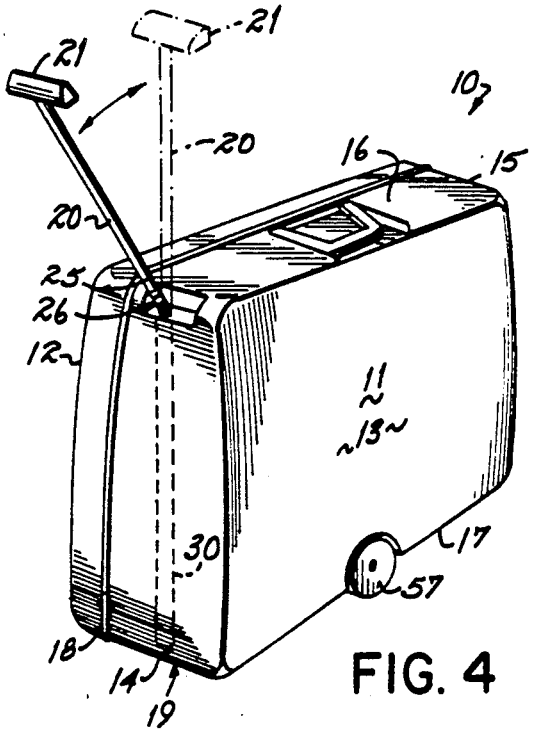

The forward wall 14 carries a rigid tubular handle 20 having a crossbar hand grip 21 at its upper end. The lower end 25 of the handle is connected by a helical spring 26 to the shell 11, the spring 26 permitting the handle to flex forward, as shown in FIG. 4.

Figure 2:
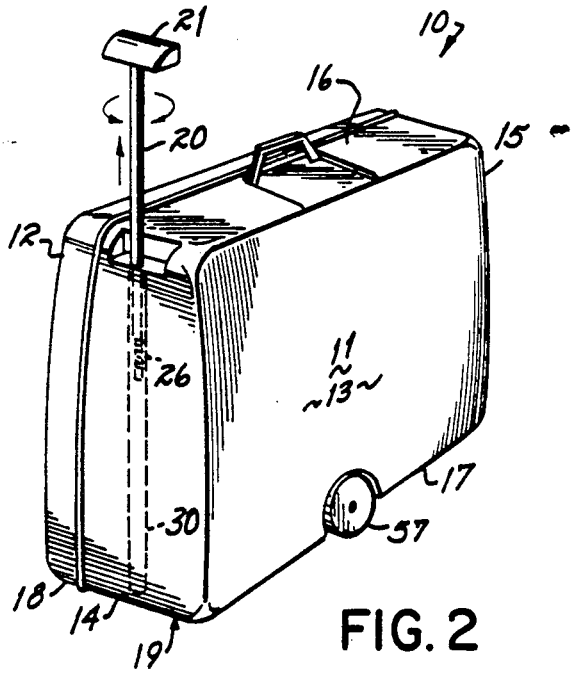
Figure 5:
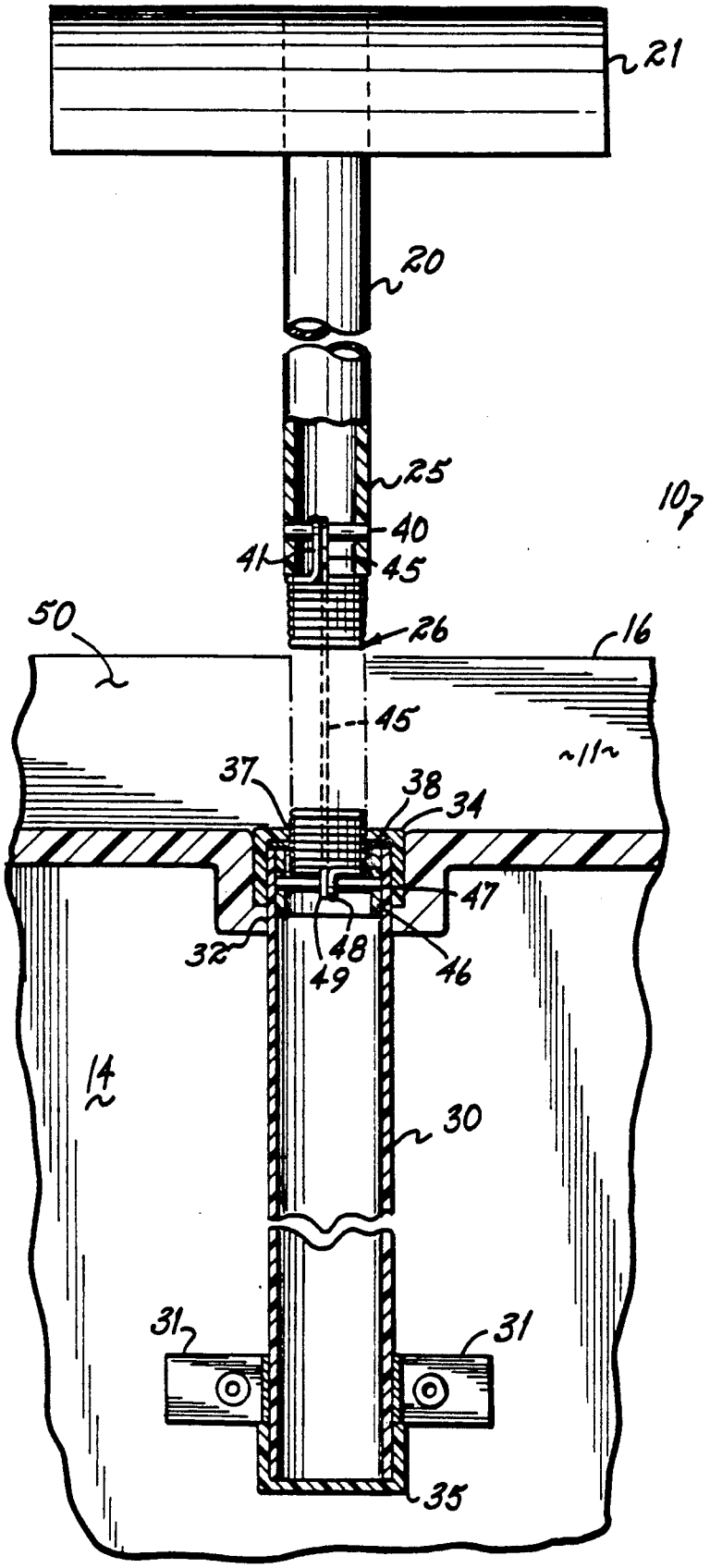
FIG. 5 is a cross-sectional view taken along lines 5—5 of FIG. 3.

The handle structure is best illustrated in FIG. 5. A sheath in the form of a tube 30 is fixed to the forward end wall 14 inside the shell 11. The tube 30 has an ID greater than the OD of handle 20, thereby permitting handle 20 to telescope within the tube 30. At its lower end, the tube 30 is snapped into a bracket 31. At its upper end, the tube is mounted in a hole 32 formed in the upper wall 16 of the shell. At its upper and lower ends, the tube 30 is enclosed by caps 34 and 35. The cap 34 at the upper end has an opening 37 through which the handle 20 passes. A friction sealing washer 38 is mounted between the cap 34 and the upper end of the tube 30 to form a seal between the handle and the shell and to provide friction for maintaining the handle in an intermediate position such as is shown in FIG. 2.

A pin 40 passes through the lower end of the handle 20. The upper end 41 of the spring 26 is connected to the pin 40. The upper end of a flexible strap 45 is also connected to the pin 40. A cylindrical stop 46 is slidable in the tube 30, but has too great a diameter to pass through the hole 37 in the cap 34 at the top of the tube. A pin 47 passes through the stop 46. The lower end 48 of the spring 26 is connected to the pin 47 and the lower end 49 of the strap 45 is connected to the pin. Thus, the engagement of the stop 46 with the washer 38 and cap 34 blocks the removal of the handle from the shell.

It is contemplated that connectors other than the spring 26 and strap 45 combination will be satisfactory. This will be demonstrated by reference to the embodiment of FIGS. 12 to 15.

Preferably, the shell has a recess 50 into which the crossbar handle grip 21 sits when the handle is fully retracted, as shown in FIG. 1.

Figure 6:
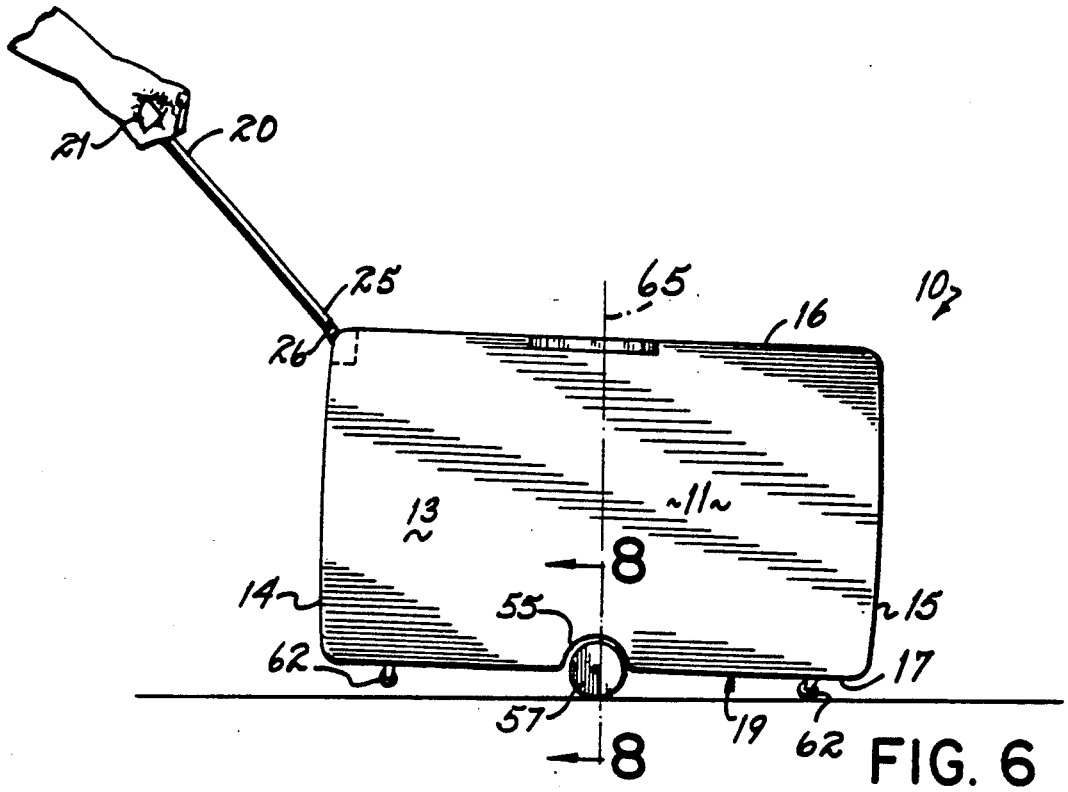
FIG. 6 is a side elevational view of the luggage.
Figure 7:
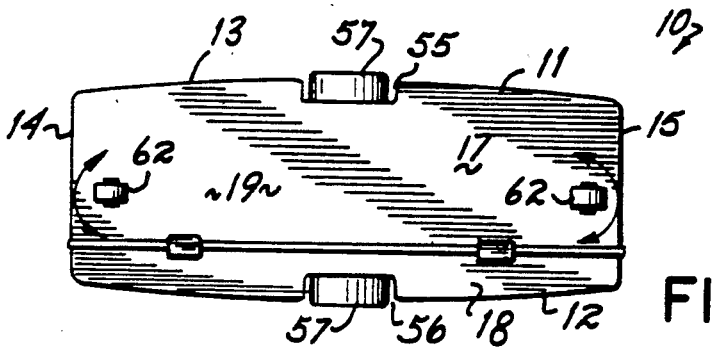
FIG. 7 is a bottom plan view of the luggage.
Figure 8:
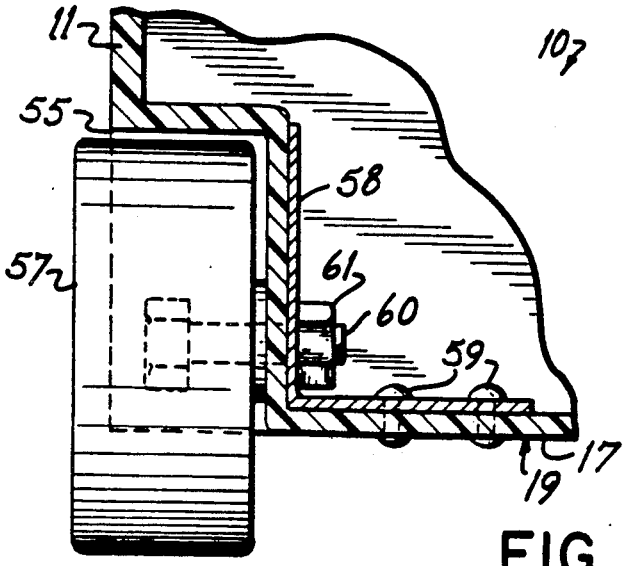
FIG. 8 is a cross-sectional view taken along lines 8—8 of FIG. 6.

The bottom wall 19 of the luggage is shown in FIGS. 7 and 8. The lid 12 and shell 11, respectively, are recessed at 55 and 56 creating wheel wells to receive major wheels 57. The major wheels are preferably at least about two inches in diameter. An L-shaped backing plate 58 is riveted at 59 to the bottom wall on the shell 11 and lid 12, respectively. An axle 60 is secured by a nut 61 to mount each major wheel 57 to the luggage. Minor castered wheels 62 (about one inch in diameter) are mounted on each end of the bottom wall 19. The lower surface of the castered wheels preferably is above the lower surface of the major wheels when the wall 19 is in a horizontal attitude. This arrangement permits only a three-wheel support, as illustrated in FIG. 6. It also permits the luggage to be spun on a vertical axis 65 passing through the axes of the major wheels 57 when neither minor wheel 62 touches the ground. This wheel design provides maximum maneuverability of the luggage. The luggage can be maneuvered satisfactorily with all four wheels at the same level.

In operation, the handle is normally retracted, as shown in FIG. 1. The handle can be raised to and frictionally held in an intermediate position, as shown in FIG. 2. This permits the user to stand alongside the luggage and push on the handle 20 to inch the luggage along while standing in an airport ticket line, for example.

Figure 3:
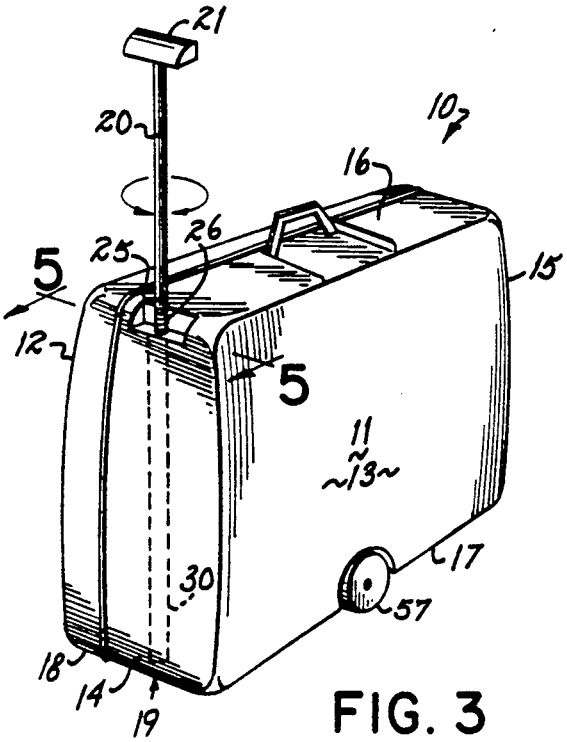

To position the handle in an attitude for pulling the luggage, the handle is first raised to a fully vertically-extended position shown in FIG. 3. In this position, the spring 26 and strap 45 project out of the shell. The handle can be put in a pulling attitude by leaning it forward and flexing the spring and the strap. When the handle is released, the spring urges the handle back to its vertical position so that it can be retracted into the shell simply by pushing down on it. The strap provides a tensile element that prevents the spring from extending and retracting with a springiness that would diminish control when the luggage is being pulled.

The invention has been described in connection with hard-sided luggage. It is to be understood that it is applicable to soft-sided luggage of the type depicted in FIGS. 9–11. Modifications have been made in order to accommodate the wheels and the telescoping pull handle.

Figure 10:
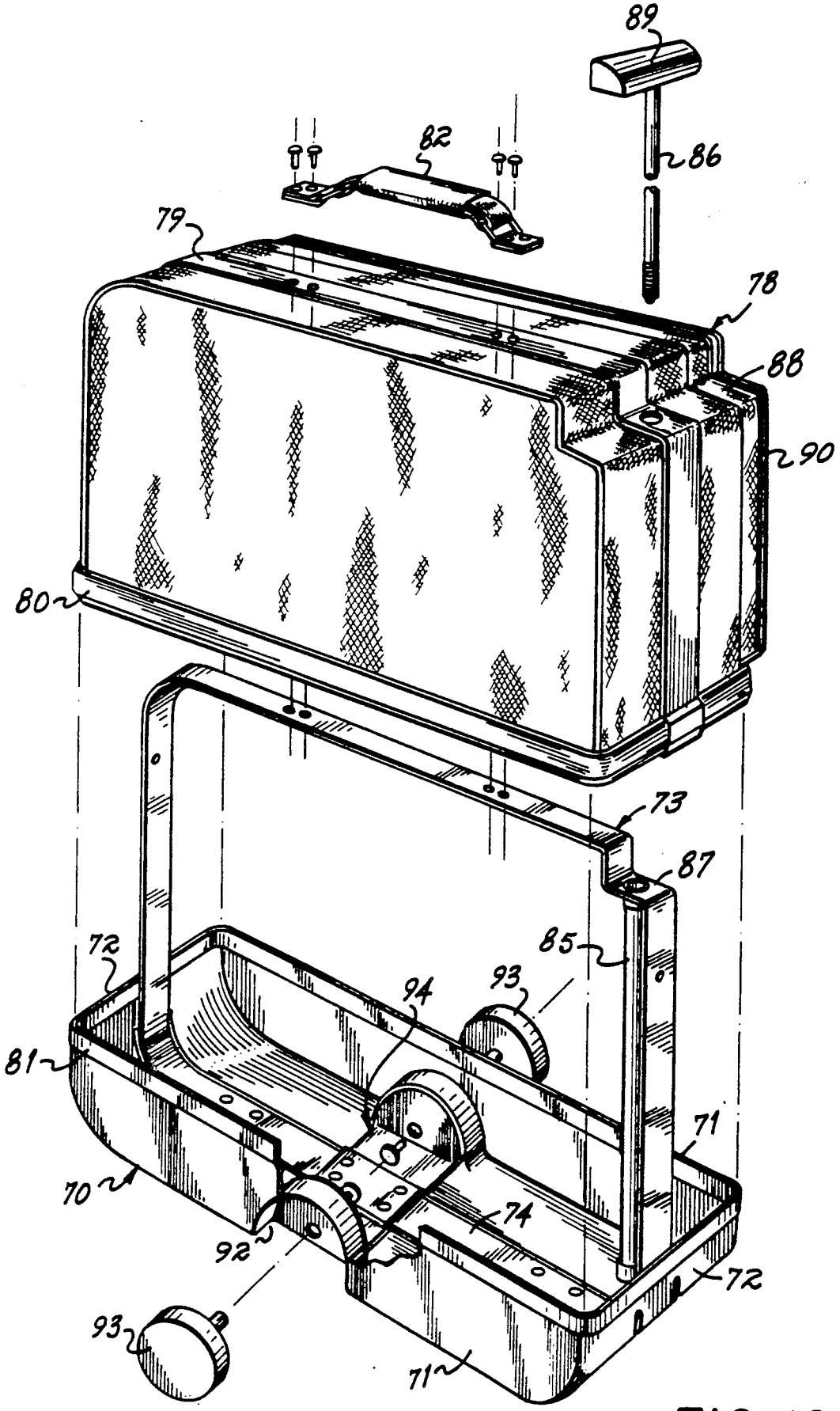
FIG. 10 is a disassembled perspective view of the embodiment of FIG. 9.

The luggage has a rigid bottom section 70. As best shown in FIG. 10, the bottom section 70 is basket-shaped and has side walls 71 and end walls 72.

Figure 11:
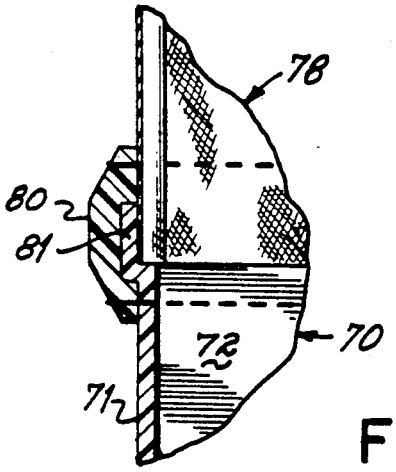
FIG. 11 is a cross-sectional view taken along lines 11—11 of FIG. 9.

A rigid frame 73 projects upwardly from the bottom section 70. The frame 73 is generally rectangularly-shaped and has a bottom strap 74 that is riveted to the bottom section 70. A soft-sided upper section 78 has a central inverted U-shaped rigid strap 79 by which the upper section is attached to the frame 73. A lower rim 80 is secured around the perimeter of the lower edge of the fabric and seats on a mating rim 81 forming the upper edge of the bottom section 70, the two rims being joined as by stitching, as shown in FIG. 11, to connect the soft-sided upper portion 78 to the bottom section 70. A handle 82 is riveted to the strap 79.

Figure 9:
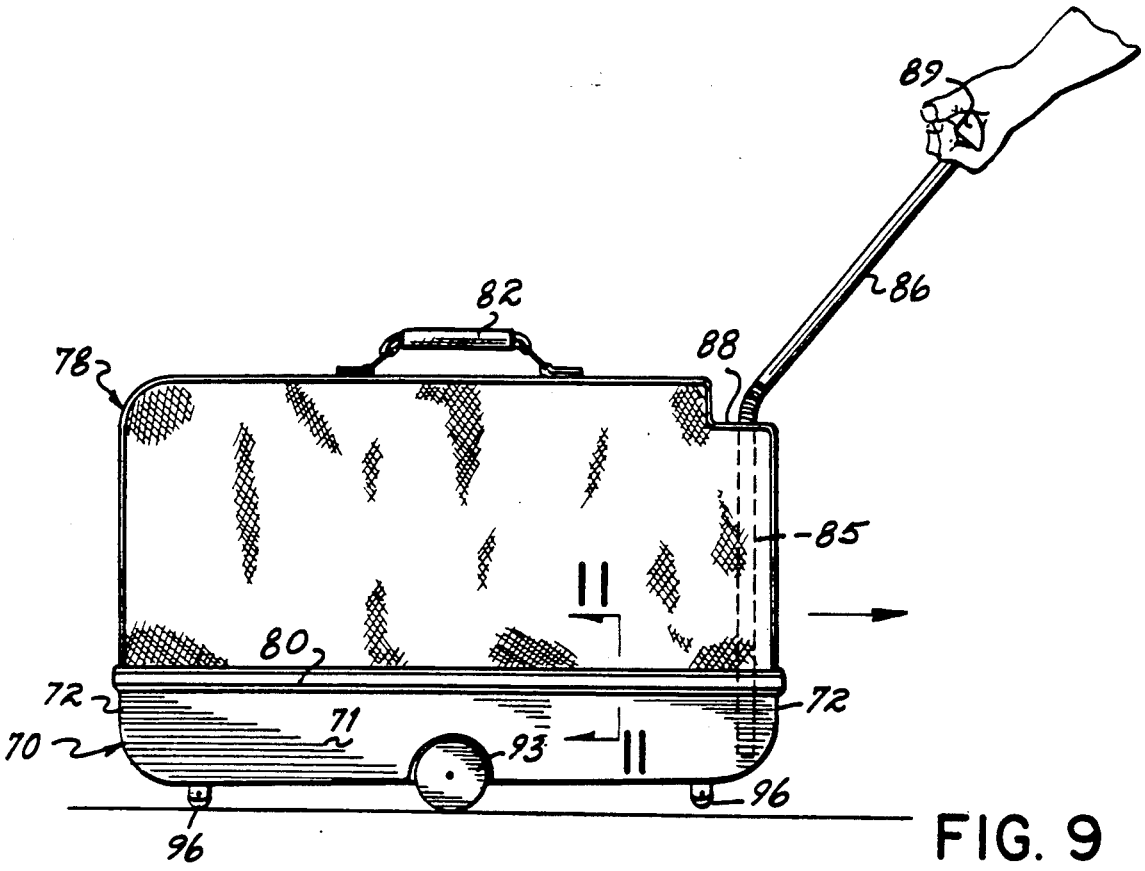
FIG. 9 is a side elevational view showing the invention with soft-sided luggage.

The frame 73 carries a tube 85 forming a sheath for a telescoping rigid handle 86. In this embodiment, the handle is formed as depicted in FIG. 5 but admits of variations which will permit the handle to telescope and to pivot forwardly, as shown in FIG. 9.

The frame 73 has a shoulder 87 to which the upper end of the tube 85 is connected. The soft-sided upper section 78 is also shouldered as at 88 to seat on the shoulder 87 and to form a recess for receiving the transverse hand grip 89 on the rigid handle 86. A soft-sided lid 90 is fastened to and forms a part of the upper section 78 by means of a stitched connection at its bottom edge and a zippered section around its perimeter, as is conventional.

The bottom section 70 has recesses 92 on each side forming wells for major wheels 93. Internally, the bottom section 70 has a U-shaped steel bracket 94 to which the major wheels 93 are rotatably mounted. Castered minor wheels 96 are mounted on the bottom section adjacent each end of the luggage (see FIG. 9).

The operation of the soft-sided luggage is identical to that of the hard-sided luggage. In the alternative form of the invention as shown in FIGS. 12 to 16, the handle 100 is an elongated flat element having, at its upper end, a handle grip 101. The luggage 102 is recessed at a corner 103 to receive the handle grip 101.

The luggage has a shell 105 as in the embodiment shown in FIGS. 1 to 8. The shell has a bottom wall 106 recessed at 107 to receive large intermediate wheels 108.

Figure 16:
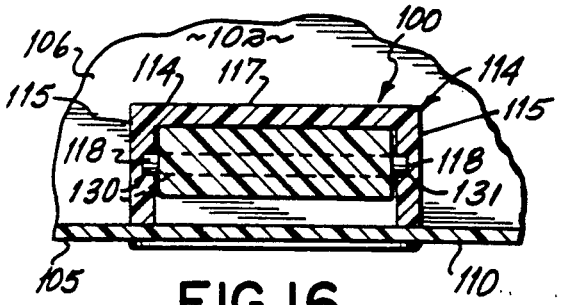
FIG. 16 is a cross-sectional view taken along line 16—16 of FIG. 13.
Figure 13:
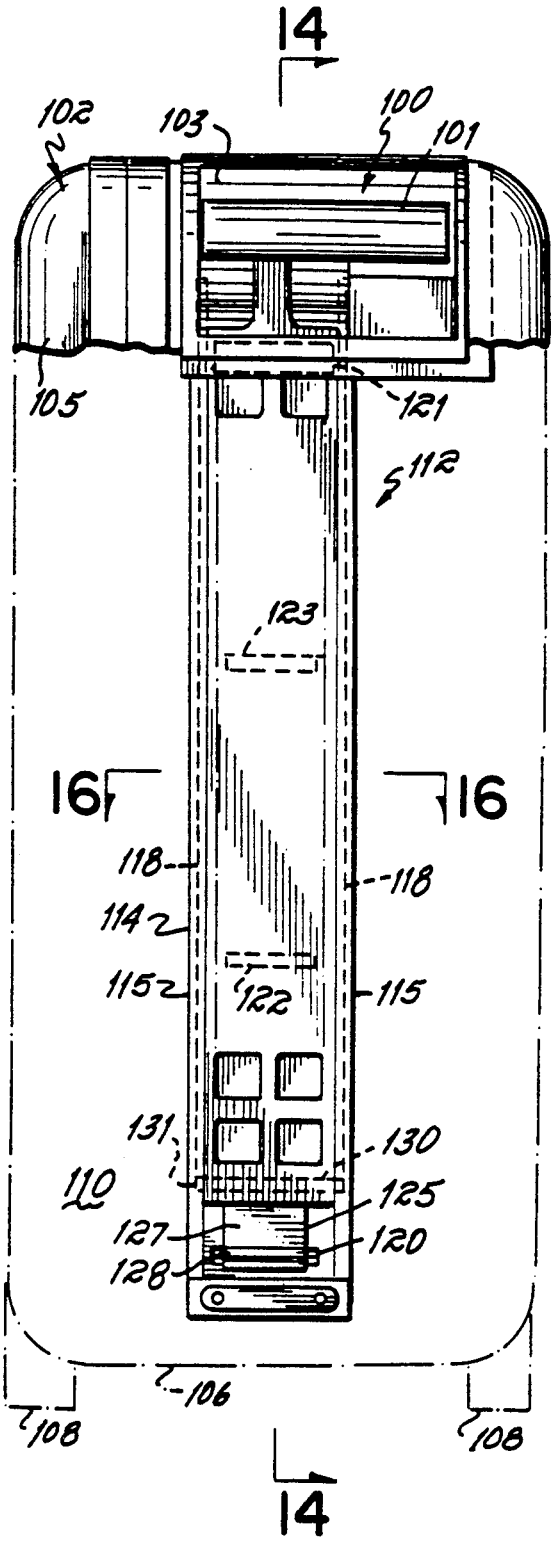
FIG. 13 is an elevational view of the telescoping handle structure.
Figure 14:
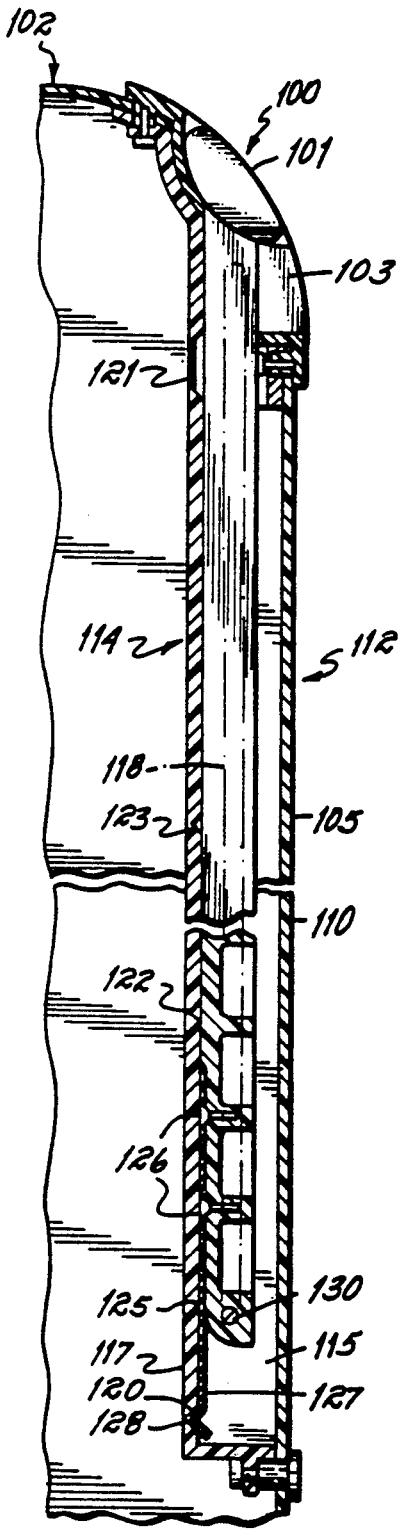
FIG. 14 is a cross-sectional view taken along lines 14—14 of FIG. 13.
Figure 15:
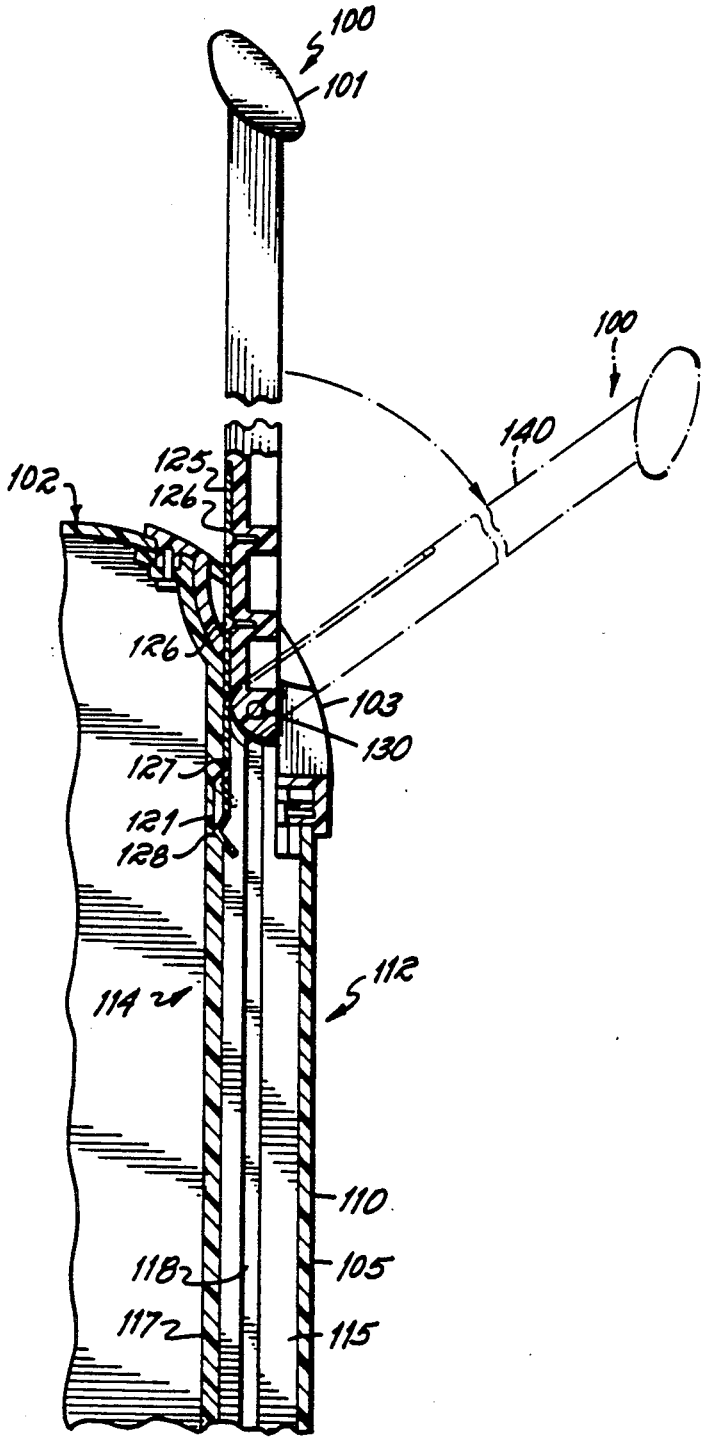
FIG. 15 is a view similar to that of FIG. 14 showing the handle in a vertical position and pivoted forward to an operative pulling position.

The shell has an end wall 10. A sheath 112 is formed in the end wall 110. As shown in FIGS. 14, 15, and 16, the sheath is formed in part by the shell end wall 110 and by a handle guide 114. The handle guide is U-shaped in cross-section (FIG. 16) and has a pair of side walls 115 and an inner wall 117. The side walls have vertical channels 118. The inner wall 117 has vertically spaced recesses at the lower end 120, the upper end 121, and intermediate recesses 122 and 123.

The pull handle 100 is flat and generally rectangular in cross-section. At its lower end, a leaf spring 125 is secured by screws 126 to the handle 100. The leaf spring has a free downwardly-projecting portion 127 which has a detent 128 that projects toward the inner wall 117 of the handle guide 114.

The handle, at its lower end has a transverse pin 130 having ends 131 projecting from the handle into the channels 118 of the handle guide. At the upper end of the channels 118 a stop (not shown) is formed, the stop being engageable by the transverse pin 130 to limit the upper extent of the movement handle.

In the operation of the embodiment of FIGS. 12 to 16, the handle is normally held in its telescoped position of FIG. 14 by the spring detent 128 being disposed in the recess 120 at the lower end of the sheath in which the handle slides.

When the handle is to be used as a pull, it is raised to its fullest extent, as shown in FIG. 15. There the detent 128 drops into the upper recess 121. Further, the transverse pin 130 engages the stop at the upper end of the channel 118. The handle can be raised no further. In this raised position, the handle can be swung to a forward inclined position as shown at 140 so that the luggage can be pulled along the floor, rolling principally on the wheels 108. In pulling the handle forward as shown at 140, the spring 125 is bent, stressing it so that when the handle is released, it naturally will swing back to the vertical position shown in full lines in FIG. 15.

Figure 12:
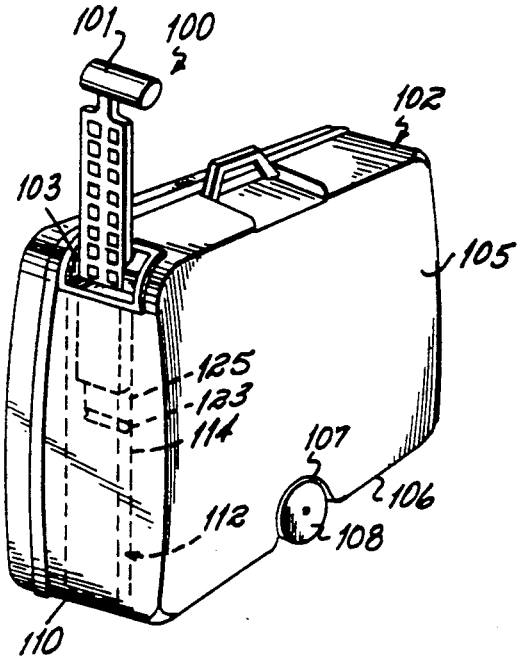
FIG. 12 is a perspective view of an alternative form of the invention.

The handle can be adjusted to an intermediate position and maintained there by the detent 128 dropping into either of the recesses 122 and 123. In that intermediate position, such as depicted in FIG. 12, the handle is in an ideal position for inching the luggage along as when standing in line at the airline ticket counter.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. In luggage having a bottom wall, a top wall, opposed front and rear end walls and opposed side walls, a wheel system comprising:

a pair of major wheels rotatably mounted on transverse axles fixed to the said luggage adjacent said bottom wall and projecting below said bottom wall, said major wheels being centered longitudinally between said front and rear end walls, a castered wheel mounted on said bottom wall adjacent each end wall, and elongated means attached to the luggage adjacent to the upper end of said front end wall for pulling said luggage as it rolls primarily on said major wheels, said major wheels, being on fixed axles, maintaining the luggage tracking in the direction in which it is pulled, while said castered wheels provide low friction ground support for the forward and rearward ends of said bottom wall.

2. A wheel system as in claim 1 in which said major wheels have ground-engaging surfaces that are below the ground-engaging surfaces of said castered wheels when said bottom wall is horizontal.

3. A wheel system as in claim 1 further comprising:

means forming recesses in said side walls receiving said major wheels, a plate mounted on the inside of each said side wall adjacent said recesses, said major wheel axles being mounted on said plates.

4. Luggage comprising:

a container having a top wall, a bottom wall, opposed front and rear end walls and a side wall, a lid having a bottom wall hinged to said container bottom wall and having a side wall, said side walls having central recesses adjacent said bottom walls, a pair of major wheels rotatably mounted in said recesses on transverse axles that are fixed to said side walls adjacent said bottom wall, said major wheels being centered longitudinally between said end walls, caster wheels mounted on said container bottom wall adjacent said end walls, and elongated means attached to the luggage adjacent to the upper end of said front end wall for pulling said luggage as it rolls primarily on said major wheels, said major wheels, being on fixed axles, maintaining the luggage tracking in the direction in which it is pulled, while said castered wheels provide low friction ground support for the forward and rearward ends of said bottom wall.

5. Luggage comprising:

a container having walls including a bottom wall and and end wall, wheels mounted on the bottom wall, a vertical sheath in said end wall, said sheath being open at its upper end and having a vertical handle guide, vertical channels, having limit means in their upper ends, disposed in said handle guide, an elongated, rigid handle slidable in said sheath and projecting from the open upper end of said sheath, a leaf spring, means for mounting the leaf spring on the lower end of said handle, and a transverse pivot pin mounted in the lower end of said handle and having ends projecting into said channels to limit upward movement of said handle, said handle, when in its uppermost position, being pivotable to an inclined position to provide a pull for said luggage, said leaf spring returning said handle to a vertical position when it is released.

6. Luggage as in claim 5 in which said leaf spring projects downwardly below said handle, said leaf spring having a laterally-projecting detent, and vertically spaced recesses in said handle guide to receive said leaf spring detent when said handle is in lowermost, uppermost and intermediate positions.

7. Luggage comprising:

a generally rectangular container having a side wall, end walls, a top wall, a bottom wall and a lid, wheels mounted on the bottom wall, and a rigid handle, means for mounting said rigid handle on an inside surface of an end wall for movement between a retracted position wherein the handle is retracted into said container, and an extended position wherein the handle extends fully above said container, said handle having a lower end, means pivoting the lower end of said handle to said luggage to permit said handle to swing to a forwardly-inclined attitude for pulling said luggage, spring means urging said handle, when in extended position, to a vertical attitude perpendicular to the top wall of said luggage.

8. Luggage as in claim 7 wherein said means for mounting includes:

an elongated tube fixed to said one end wall, said handle being rigid, elongated, and slidable in said tube.

9. Luggage as in claim 7 further comprising:

said handle having a crossbar on its end, said top wall of said container having a recess to receive said crossbar when said handle is retracted into said luggage.

10. Luggage comprising:

a generally rectangular container having a side wall, end walls, a top wall, a bottom wall and a lid, wheels mounted on the bottom wall, and a rigid handle, means for mounting said rigid handle on an inside surface of an end wall for movement between a retracted position wherein the handle is retracted into said container, and an extended position wherein the handle extends fully above said container, said handle having a lower end, means pivoting the lower end of said handle to said luggage to permit said handle to swing to a forwardly-inclined attitude for pulling said luggage, means for maintaining said handle in an intermediate, refracted position between fully retracted and fully extended positions for ease in pushing on the handle to move said luggage small increments of distance.

11. In luggage having a bottom wall, a top wall, opposed front and rear end walls, and opposed side walls, a wheel system comprising:

a pair of major wheels rotatably mounted on axles fixed to said luggage adjacent said bottom wall and projecting below said bottom wall, said major wheels being centered longitudinally between said front and rear end walls, a castered wheel mounted on said bottom wall adjacent each end wall, and an elongated, rigid handle, and means for pivotally attaching said handle to the luggage adjacent to the upper end of said front wall for pulling said luggage as it rolls primarily on said major wheels and for maintaining directional control over said luggage, said major wheels, being on fixed axles, maintaining the luggage tracking in the direction in which it is pulled, while said castered wheels provide low friction ground support for the forward and rearward ends of said bottom wall.

* * * * *